United States Patent [19]

Morita et al.

[11] Patent Number: 4,545,307

[45] Date of Patent: Oct. 8, 1985

[54] APPARATUS FOR COAL COMBUSTION

[75] Inventors: Shigeki Morita; Tadahisa Masai; Shigeto Nakashita; Toshio Uemura; Fumio Kouda; Tsuyoshi Nawata, all of Kure, Japan

[73] Assignee: Babcock-Hitachi Kabushiki Kaisha, Tokyo, Japan

[21] Appl. No.: 617,188

[22] Filed: Jun. 4, 1984

[30] Foreign Application Priority Data

Apr. 23, 1984 [JP] Japan ..... 59-81646

[51] Int. Cl.[4] ..... F23D 1/02

[52] U.S. Cl. ..... 110/264; 110/263; 110/347

[58] Field of Search ..... 110/263, 264, 265, 347; 431/348

[56] References Cited

U.S. PATENT DOCUMENTS 3,788,796 1/1974 Krippene et al. ..... 110/264 X 4,147,116 4/1979 Graybill ..... 110/263

4,223,615 9/1980 Breen et al. ..... 110/264

4,422,389 12/1983 Schroder ..... 110/264

*Primary Examiner*—Edward G. Favors

*Attorney, Agent, or Firm*—Beall Law Offices

[57] ABSTRACT

A coal combustion apparatus capable of improving $NO_x$ reduction to a large extent is provided, which apparatus comprises a pulverized coal-feeding pipe (abbreviated to coal pipe) inserted into a burner throat on the lateral wall of a combustion furnace and for feeding the coal and air into the furnace; a means for feeding the coal and air into the coal pipe; a secondary air passageway formed between the coal pipe and a secondary air-feeding pipe provided on the outer peripheral side of the coal pipe; a ternary air passageway formed on the outer peripheral side of the secondary air-feeding pipe; a means for feeding air or an oxygen-containing gas into the secondary air passageway and that into the ternary air passageway; and a bluff body having a cross-section of a L-letter form provided at the tip end of the coal pipe.

17 Claims, 7 Drawing Figures

APPARATUS FOR COAL COMBUSTION

BACKGROUND OF THE INVENTION

1. Fields of the Invention

This invention relates to a combustion apparatus for reducing the amount of nitrogen oxides (hereinafter abbreviated to $NO_x$) and particularly it relates to a combustion apparatus capable of achieving a very low content of $NO_x$ at the time of burning pulverized coal.

2. Description of the Prior Art

Due to change in the recent fuel situation, large-scale boilers for such establishments as thermal power stations wherein coal is used as their fuel have been increasing. In this case, coal has been pulverized into e.g. pulverized coal of which about 70% is 200 meshes pass to improve combustibility and controllability.

As is well known, however, $NO_x$ byproduced by combustion is likely to be generated in high-load combustion burners and it has been one of main causes of air pollution; thus, certain basic improvements in burners or improvement in combustion over the whole of combustion furnaces have been made. A particular problem raised in the combustion of pulverized coal is that an organic-type nitrogen (hereinafter referred to as Fuel N) contained in a large amounts (usually 1 to 2% by weight) in pulverized coal generates $NO_x$ and this $NO_x$ constitutes most part of the $NO_x$ generated in combustion.

Now, the respective formation reactions of $NO_x$ and $N_2$ from the Fuel N are expressed by the following equations (1) and (2) and these two reactions are competitively carried out:

$$\text{Fuel N} \xrightarrow{+O_2} NO_x \quad (1)$$

$$\text{Fuel N} \xrightarrow{+NO} N_2 \quad (2)$$

Thus, in order to make $N_2$ formation predominant and maintain a high-load combustion, it is important to ensure a high temperature reducing flame.

In general, a combustion process referred to as two-stage combustion is an application of this combustion reaction. Namely, as shown in FIG. 1, an air-deficient zone is formed in the burner zone 53 of a combustion furnace 51 and an amount of air corresponding to the above deficient amount of air is supplied through the so-called after air port 57 provided downstream of burners 55 to effect complete combustion, whereby combustion over the whole of the combustion furnace is improved to thereby reduce the amount of $NO_x$ discharged. In the case of newly established boilers using general coals as fuel, the concentration of $NO_x$ discharged therefrom has currently come to be reduced down to about 200 ppm.

However, in the case of the two-stage combustion, half-burned coal particles (char) are formed in the air-deficient burner zone, and it requires a large free space in the furnace for complete combustion of the char with after-air. Thus, although the above combustion process is very effective in lowering $NO_x$ in the combustion, it has still a certain limitation.

Thus, the so-called dual resistor type burner has been developed which is constructed so that the respective burners can effect a low $NO_x$ combustion based on the above principle, in place of controlling the combustion over the whole of boilers. FIG. 2 illustrates the dual resistor type burner. Pulverized coal is carried by a carrier air (primary air) in an amount of about 20 to 30% of combustion air, passed through a pulverized coal pipe 8 in the form of pulverized coal stream, and injected through an injection port 9 into a combustion furnace. This pulverized coal stream is burned within the combustion furnace in a low air ratio, to form reducing intermediate products and reduce a part of $NO_x$ in gas phase. On the other hand, at the outer peripheral part of the flame formed by combustion of the pulverized coal stream is fed through an injection port 11, a secondary air 4 passed through a secondary air resistor 12 and having a whirling force imparted by an air vane 16, and further at the outer peripheral part thereof is fed through an injection port 7, a ternary air 6 passed through a ternary air resistor 14. Thus, air is fed to the flame after the gas phase reduction to burn unburned matters. In such a manner, a two-stage combustion is carried out by means of a single burner, and reduction of $NO_x$ down to about 400 ppm (percentage reduction : about 40%), for example, has been demonstrated. In order to achieve a low $NO_x$ concentration by means of such a type burner, it is required that the burner flame be separated from the secondary air and the ternary air in the vicinity of a burner throat 18 in the combustion furnace to form a good reducing atmosphere, and also that to the contrary, downstream of this flame, the flame (or gas) be mixed with these airs to well burn unburned matters. In the case of such a type burner, however, although the secondary air 4 is usually separated from the ternary air 6 by means of a sleeve 10, practically it has been found that the pulverized coal stream, the secondary air stream and the ternary air stream readily mix together in the vicinity of the exit of the burner throat to make it difficult to sufficiently separate and maintain the high temperature reducing flame at the initial stage of the combustion. Further, the flame-maintenance by way of conventional type burners has resorted to impellers of the so-called broad-angle spread type to make it very difficult to cause the high temperature reducing flame to exist in the vicinity of the central axis of burner in a concentrated manner.

SUMMARY OF THE INVENTION

In view of the above problems, the object of the present invention is to provide a combustion apparatus capable of improving the $NO_x$ reduction to a large extent.

The present invention resides in an apparatus for coal combustion which comprises;

a pulverized coal-feeding pipe (hereinafter referred to as pulverized coal pipe) inserted into a burner throat on the lateral wall of a combustion furnace and for feeding pulverized coal together with air into the combustion furnace;

a means for feeding pulverized coal and air into the pulverized coal pipe;

a secondary air passageway formed between the pulverized coal pipe and a secondary air-feeding pipe provided on the outer peripheral side of the pulverized coal pipe;

a ternary air passageway formed on the outer peripheral side of the secondary air-feeding pipe;

a means for feeding air or an oxygen-containing gas into the secondary air passageway and that into the ternary air passageway; and a bluff body having a cross-section of a L-letter form provided at the tip end of the pulverized coal pipe.

DETAILED DESCRIPTION OF THE PREFERRED EMBODIMENTS

Figure 1:
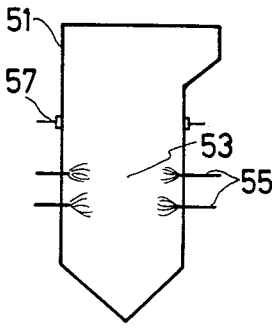
FIG. 1 shows a schematic view of a conventional two-stage combustion apparatus.

The present invention will be concretely described by way of embodiments illustrated in the drawings.

Figure 3:
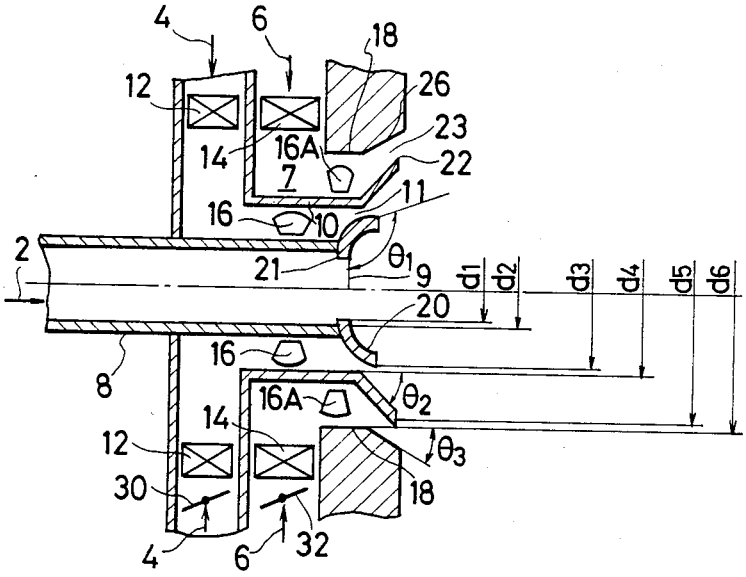
FIG. 3 shows an explanatory view illustrating an embodiment of the coal combustion apparatus of the present invention.
Figure 4:
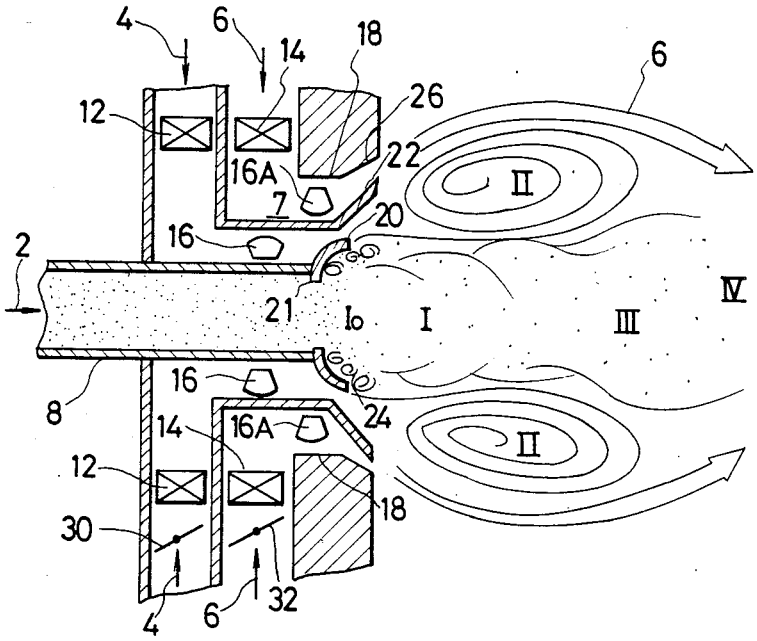
FIG. 4 shows an explanatory view typically illustrating the combustion state in the apparatus of FIG. 3.

FIG. 3 shows a cross-sectional view illustrating the basic constitution of the combustion apparatus of the present invention, and FIG. 4 shows an explanatory view typically illustrating the state at the time of combustion in the apparatus of FIG. 3, as described above. This apparatus is composed of a pulverized coal pipe 8 opened at a burner throat part 18 on the lateral wall of a combustion furnace, and an injection port 9 of the pipe; a secondary air pipe 10 provided in the form of double tube so as to form a secondary air passageway on the outer periphery of the pulverized coal pipe, and an injection port 11 of the pipe 10; a ternary air passageway 7 provided between the secondary air passageway 10 and the burner throat 18 on the outer pheriphery of the passageway 7, and an injection port of the passageway 7; a bluff body 20 having a L-letter form cross-section provided at the injection port 9 of the pulverized pipe 8; a damper 30, a secondary air resistor 12 and an air vane 16, each provided in the air passageway of the secondary air pipe 10; a damper 32, a ternary air resistor 14 and an air vane 16A, each provided in the passageway 7 of the ternary air; and an outward guide sleeve 22 provided at the end part of the secondary air pipe 10.

Figure 6:
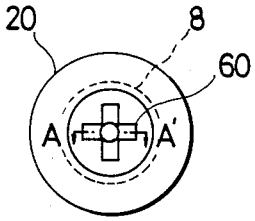
FIG. 6 shows a detailed view of a cross-form plate fixed onto the tip end of pulverized coal pipe in the present invention.
Figure 7:
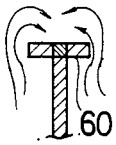
FIG. 7 shows a cross-sectional view of FIG. 6 as viewed from an arrow mark direction along A—A plane.

In the above constitution of the burner, the bluff body 20 having a L-letter form cross-section is in the form of a ring-form dish having a hole through which the pulverized coal stream is passed, at the central part thereof, and is provided at the opening end of the pulverized coal pipe 8, one side of the member having a L-letter form cross-section being formed nearly perpendicularly to the axial direction of the pulverized coal pipe 8 and the other side thereof being formed either in parallel to the axial direction of the pulverized coal pipe toward the combustion furnace or at such an angle that the side is enlarged in the radial direction. Further, in order to enhance ignitability at the exit of the injection port of the pulverized coal pipe and also to generate the high temperature reducing flame at the exit end with certainty, if there is provided an apron formed by some protrusion of the inner peripheral surface margin of the pulverized coal pipe at the exit of the injection port thereof toward the inside of the pulverized coal pipe 8, then it is possible to more ensure the effectiveness of the present invention. In FIGS. 3 and 4, the apron is shown in the form of a continuous ring, but it may be serrated i.e. provided with cut-away parts therein. Further, at the exit of the injection port may be provided a cross-form plate 60 or a straight line plate 60 for inside ignition as shown in FIGS. 6 and 7. The inner diameter or dimension $d_1$ of the bluff body 20 and the inner diameter $d_2$ of the pulverized coal pipe 8 are preferably determined so as to satisfy a relation of $0.7 \leqq (d_1/d_2) \leqq 0.98$, and most preferably determined so as to give a $d_1/d_2$ of about 0.9. The ratio of $d_1/d_2$ is not limited to the above range, but if the ratio of $d_1/d_2$ is too small, the bluff body protrudes too much toward the inside of the pulverized coal pipe to increase the flow rate of the pulverized coal stream passing through the injection port 9 and hence increase the pressure drop inside the coal-feeding pipe. The angle $\theta_1$ formed between two sides of the L-letter form in cross-section of the member of the bluff body 20 has a flame-maintenance effectiveness even in the case of less than 90°, but usually it is preferred to be 90° or more (particularly 90° to 150°), whereby a function of extending the secondary air stream around the bluff body toward the outside thereof is added and it is possible to well separate the central reducing flame I from the oxidizing flame II surrounding the flame I. Further, between the exit of the pulverized coal pipe 8 and the reducing flame I is formed a combustion zone $I_o$ of volatile matters of pulverized coal, which zone is adjacent to the reducing flame I.

As to the distance between the bluff body 20 and the secondary air pipe 10, i.e. the size of the ring-form injection port 11 for the secondary air, the ratio of the difference $(d_3-d_x)$ between the outer diameter $d_3$ of the bluff body and the inner diameter $d_2$ of the pulverized coal pipe 8, to the difference $(d_4-d_2)$ between the inner diameter $d_4$ of the secondary air pipe 10 and the inner diameter $d_2$ of the pulverized coal pipe 8, is preferred to be 0.5 or more (i.e. $(d_3-d_2)/(d_4-d_2) \geqq 0.5$), particularly in the range of 0.5 to 0.9. The ratio is not limited to the above range, but if the size of the injection port 11 for the secondary air is too large, separation of the secondary air form the reducing flame I is insufficient and since the secondary air mixes in the reducing flame, the reducing radical is liable to be oxidized. If the size of the injection port 11 is too small, it is difficult to feed a sufficient amount of the secondary air and power consumption increases due to the increase in the flowpassage resistance.

Around the outer peripheral part of the pulverized coal pipe 8 is provided the secondary air pipe (sleeve) 10, and further around this pipe 10 and between this pipe 10 and a burner throat 18 is provided a passageway for the ternary air 7, to form a ring-form passageway. These sleeves may take a shape wherein the diameter thereof is not enlarged at their tip end part, that is, the whole of the sleeves may take a shape of cut cylinder, but as shown in FIGS. 3 and 4, it is preferred to provide an outward guide sleeve 22 at the end part of the secondary air pipe 10 and also provide a funnel-like part 23 at a burner throat 18, so that the diameter may be enlarged toward the opening end. When such a shape is taken, it is possible to carry out the separation of the gases more effectively as described later. Further, the bluff body 20 and the guide sleeve 22 may be so constructed that the respective wall thicknesses of the members may be gradually increased toward the opening end on the side of the combustion furnace whereby the respective outer diameter parts develop toward the opening end at an acuter angle than the angle at which the respective inner diameter parts do.

The guide sleeve 22 provided at the end part of the secondary air pipe 10 has a shape wherein its diameter is enlarged toward its opening end, as described above, and the angle $\theta_2$ of the guide sleeve 22 with the horizontal axis is preferred to be in the range of 30° to 50° so that an oxidizing flame II due to the secondary air may be formed outside the reducing flame I, as shown in FIG. 4. This angle is not always limited to the above range, but if it is too small, the oxidizing flame II comes inward to narrow the high temperature reducing flame I and also often cause a burning loss of the guide sleeve 22. If the angle is too large, the ternary air leaving an injection port 23 outside the guide sleeve 22 is dispersed and reversed along the wall inside the furnace to make it difficult to join in a combustion zone IV. Further, $\theta_2$ is preferred to be determined in consideration of the size of an angle $\theta_3$ at the funnel-like part 26 of the burner throat. As to the size of the injection port 11 of the secondary air pipe 10, when the inner diameter of the secondary air pipe 10 is $d_4$, the outer diameter of the guide sleeve 22 is $d_5$, and the inner diameter of the burner throat 18 is $d_6$, the size is preferred to be $(d_5-d_4)/(d_6-d_4) \geqq 0.5$, particularly $(d_5-d_4)/(d_6-d_4)=0.5$ to 0.9.

The secondary air 4 is passed through a damper 30 and an air resistor and given a whirling force at a secondary air vane 16. Thereafter it is passed through the bluff body 20 having a cross-section of a L-letter form and a pipe for feeding the secondary air 10 and blown in the furnace through the injection port 11. This secondary air is consumed at the time of forming the oxidizing flame II in FIG. 4.

The ternary air 6 (passageway 7) is passed through a damper 32, an air resistor 14 and a ternary air vane 16A and blown in the furnace through an injection port 23 formed between the guide sleeve 22 of the secondary air pipe 10 and the burner throat 18. The air is then once dispersed outward due to the angle of the guide sleeve 22 and the whirling force imparted by the air resistor 14 and the air vane 16A, and thereafter joins downstream of a denitration zone III to form a complete oxidation zone IV (see FIG. 4). In order to form a clear complete oxidation zone IV, it is preferable to provide a whirl-imparting means such as the air vane 16A to thereby impart a powerful whirling force to the ternary air. When the ternary air is whirled as above, the air is once dispersed outward and then joins, with certainty, the complete oxidation zone IV which is an after-stream zone where denitration reaction has been completed, whereby it is possible to completely burn unburned matters.

In the burner apparatus shown in FIGS. 3 and 4, pulverized coal is passed, in the form of pulverized coal stream 2, through the pulverized coal pipe 8 and the injection port 9 and injected into the inside of the furnace. At that time, as shown in FIG. 4, an eddy flow 24 is formed inside the L-letter form part of the bluff body 20 due to the bluff body member having a cross-section of a L-letter form. The eddy flow inhibits the pulverized coal stream from diffusing toward the outside of the L-letter form part, and the stream is ignited there to effect a flame-maintaining function. Namely, downstream of the bluff body is generated an eddy flow zone wherein pulverized coal is involved from the inner side and air is involved from the outer side to form a sound ignition flame there. As a result, a high temperature reducing flame part I is formed in the vicinity of the burner. As this reducing flame part I, the nitrogen compounds in the coal are decomposed into volatile nitrogen compounds (Volatile N) and nitrogen compounds contained in the char (char N) as shown by the following equation:

$$\text{Total Fuel N} \rightarrow \text{Volatile N} + \text{Char N} \quad (3)$$

Volatile N contains radicals such as $.NH_2$,.CN, etc. as reducing intermediate products and reducing intermediate products such as CO. Even in the high temperature reducing flame, a small amount of $NO_x$ may be locally generated, but this is converted into reducing radicals by way of hydrocarbon radicals such as .CH contained in the pulverized coal stream as shown by the following equation (4):

$$NO + .CH \rightarrow .NH + CO \quad (4)$$

Further, around the high temperature reducing flame I is formed the oxidizing flame II by way of the secondary air 4 and this flame II oxidizes Volatile N from the high temperature reducing flame I and nitrogen ($N_2$) in air to generate fuel NO and thermal NO, as shown by the following equations (5) and (6):

$$2\ \text{Volatile N} + O_2 \rightarrow 2NO(\text{fuel NO}) \quad (5)$$

$$N_2 + O_2 \rightarrow 2NO(\text{thermal NO}) \quad (6)$$

In the reducing zone (III), NO formed in the oxidizing flame II is reacted with reducing intermediate products (.NX) contained in the high temperature reducing flame I to form $N_2$; thus a self-denitration is carried out X represents $H_2$, C, etc.

$$NO + .NX \rightarrow N_2 + XO \quad (7)$$

In the complete oxidation zone IV formed downstream of the reducing zone III, the ternary air 6 is fed downstream of the reducing zone III, and said N-containing char (Char N) and unburned matters are completely burned there, as described above. It has been observed that at that time, Char N is converted into NO with a conversion of about several %; hence it is difficult to reduce such an amount of NO formed, by means of a hydrodynamical operation; thus it is desired to discharge Char N to the gas phase to the utmost in advance of this stage. In the present invention, since a condensed high temperature reducing flame is existent inside, discharge of Char N to the gas phase is promoted due to the high temperature of the flame, and yet after the discharge, its conversion into NO is also inhibited due to the reducing atmosphere.

Figure 5:
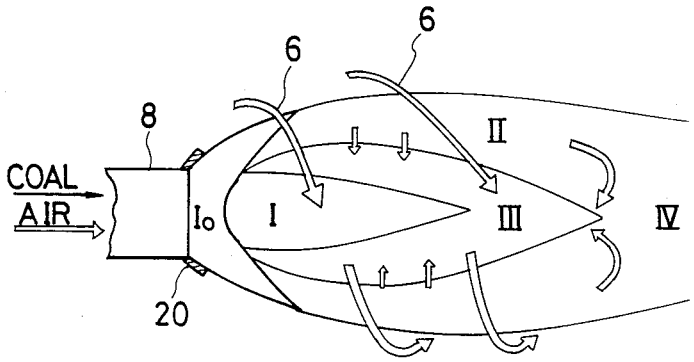
FIG. 5 shows an explanatory view illustrating the combustion state of pulverized coal in the case where a ternary air is fed in a whirling manner in the apparatus of FIG. 4.

FIG. 5 shows a view typically illustrating the structure of the pulverized coal flame in the case where the ternary air 6 is fed in the form of a whirling stream in FIG. 4. In this case, the volatile matters combustion zone $I_o$, the reducing flame part I (reducing agent-generating zone), the oxidizing flame part II (oxidation zone) and the denitration flame part III (denitration zone) are presented more clearly than those in FIG. 4.

Since the guide sleeve 22 is brought to high temperatures, it is desired to cool it for protecting its material. As means therefor, a groove like rifle tube may be formed on the outer surface of the sleeve in the same direction as the whirling direction of the ternary air to increase its surface area. Further, fins may be provided at the part where the sleeve is exposed to radiation from the combustion furnace, to thereby enhance the cooling effect. Still further, in order to prevent ash adhesion onto the sleeve 22, the sleeve may be provided with a certain number of vent holes.

At the parts where the bluff body 20 and the guide sleeve 22 are abraded, a high temperature abraision resistant material such as ceramics may be provided.

The bluff body 20 may be provided with a certain number of vent holes or notches to prevent ash adhesion. In the case where the body is notched, an effectiveness of preventing its deformation due to thermal stress is also obtained.

The bluff body 20 may be formed in a separate manner from the pulverized coal pipe 8 and fitted onto the end part of the pipe, or may be formed in an integral manner with the pipe.

Further, the bluff body 20 may be composed of a plurality of crysanthemum-form constituent pieces which are opened or closed by operation from the outside to thereby vary the dimension of the opening part (injection port 9).

When the feeding system of secondary air and the ternary air is divided into two air lines by means of a dual wind box and the respective air lines are provided with a fan to thereby independently control the amount of air fed and the air pressure applied, the technical effect of the present invention is more ensured.

Figure 2:
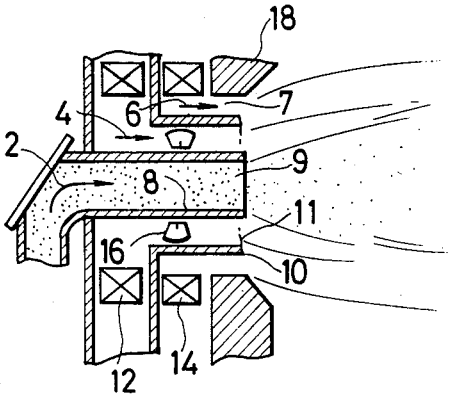
FIG. 2 shows a cross-sectional view of a conventional coal combustion apparatus.

In the present invention, the bluff body 20 is fixed to the pulverized coal pipe 8, as shown in FIG. 3, to thereby prevent pulverized coal from diffusing; hence it is possible to allow the high temperature reducing zone to come much closer to the tip end of the burner as compared with a conventional type burner shown in FIG. 2. Thus, even when the secondary air and the ternary air are injected using a conventional sleeve (numeral 10 in FIG. 2), the high temperature reducing zone is formed upstream of a point where these airs are mixed; hence it is possible to carry out a relatively good gas phase reduction. However, additionally by providing fans for separately feeding the secondary air and the ternary air, and further providing, as shown in FIG. 3, dampers 30 and 32, air resistors for the secondary air and the ternary air 12 and 14 and air vanes for the secondary air and the ternary air 16 and 16A, as whirlers at the end, to independently control the respective pressures and amounts of these airs and impart a whirling force thereto, it is possible to further well separate the secondary air and the ternary air from the high temperature reducing flame I. In this case, it has been found that when the pressure of the ternary air 6 is e.g. 120 mm Aq upstream of the air resistor 14, good results are obtained. Further, it has been found that an amount ratio of the ternary air 6 to the secondary air 4 in the range of about 3.5~4.5:1 is effective. In addition, in the case of conventional burners, the ratio is about 2:1. When the above means are employed, the secondary air 4 and/or the ternary air 6 each maintain a strong whirling force and an adequate amount and are injected through the burner throat into the furnace at a broad angle; hence even when the high temperature reducing flame is formed in the vicinity of the tip end of the burner, as described above, mixing of the high temperature reducing flame with the secondary air or the ternary air is slight in the vicinity of the tip end of the burner; thus it is possible to form a good gas phase reducing zone III. On the other hand, downstream of the high temperature reducing flame, the injection energies of the secondary air and the ternary air are reduced, these airs flow in the axial part of the burner and unburned matters are burned.

In order to reconstruct the existing burner into the combustion furnace of the present invention, it is economical to form the bluff body having a L-letter form 20 and the funnel-like part 22 at the respective tip ends of the pulverized coal pipe 8 and the secondary air pipe (sleeve) 10.

Further, it has been confirmed by experiments that when a whirling means is provided in the respective passageways of said secondary air 4 and said ternary air 6, and the secondary air 4 is injected at a different whirling strength or in a different direction from those of the ternary air 6, it is possible to form the circulating eddy of the oxidizing flame part shown by the symbol II in FIG. 4, in a stabilized manner. Due to the presence of this circulating eddy II, the outermost peripheral air (the ternary air 6) is very effectively separated from the pulverized coal stream around the circulating eddy II, and also due to the presence of this eddy, it is possible to easily carry out mixing of the ternary air with the high temperature reducing flame I, downstream of the eddy. The whirling direction of said secondary air may be the same as or contrary to that of said ternary air.

In the present invention, the air ratio (ratio of the amount of air fed, to the amount of air necessary for the theoretical coal combustion) of the primary air fed to the pulverized coal pipe 8 is 1.0 or less, preferably in the range of 0.2 to 0.35. Further, the ratio by volume of the primary air to the secondary air is preferably in the range of 1.0 to 0.7 and the ratio by volume of the ternary air to the secondary air is preferably in the range of 2:1 to 6:1, particularly 3.5:1 to 6:1.

As the primary, secondary and ternary airs, air, combustion exhaust gas, mixture thereof, etc. may be used.

The combustion apparatus of the present invention may be installed on the furnace wall as a burner apparatus in the form of a single stage or a plurality of stages or in combination with other known burner apparatus. In the case of installing it in the form of a plurality of stages, if the amount of fuel fed to a lower stage burner is larger than that to an upper stage burner, it is possible to realize a good combustion condition wherein the amount of unburned matters is small, as a whole.

According to the present invention, a bluff body having a specified shape is provided at the tip end of a pulverized coal pipe, whereby it is possible to inhibit pulverized coal from diffusing, forming a good reducing flame I in the vicinity of the injection port of the pulverized coal pipe and also forming an oxidizing flame II in a separate manner from the reducing flame I around the outer peripheral side thereof. Thus, the reducing flame I comes very close to the vicinity of the injection port of the pulverized coal pipe while it is surrounded by the oxidizing flame II and maintains a high temperature, to thereby generate a large amount of reducing intermediate products; hence when the reducing flame mixes with the oxidizing flame downstream of the reducing flame, as described above, it is possible to carry out denitration of the combustion products with a high efficiency. Further since unburned matters contained in the combustion gas are completely burned by the ternary air fed from the outer peripheral side of the secondary air, it is possible to notably reduce unburned matters contained in the combustion exhaust gas. Furthermore, flame is formed by ignition at the fuel-injecting port part with certainty; hence when the apparatus is applied particularly to burners for gas fuel which are liable to raise problems as to combustion inside the combustion furnace such as combustion vibration, etc., it is possible to obtain good results.

What we claim is:

1. An apparatus for coal combustion which comprises:

a pulverized coal-feeding pipe (pulverized coal pipe) inserted into a burner throat on the lateral wall of a combustion furnace and for feeding pulverized coal together with air into the combustion furnace;

a means for feeding pulverized coal and air into the pulverized coal pipe;

a secondary air passageway formed between the pulverized coal pipe and a secondary air-feeding pipe said secondary air-feeding pipe being concentric with the pulverized coal pipe and provided on the outer peripheral side of the pulverized coal pipe;

a ternary air passageway formed on the outer peripheral side of the secondary air-feeding pipe;

a means for feeding air or an oxygen-containing gas into said secondary air passageway and that into said ternary air passageway; and a bluff body provided at the burner end of said pulverized coal pipe and encircling and extending said pipe, said bluff body having essentially the shape of an L-letter, with a first portion of the L perpendicular to and attached to said pulverized coal pipe and a second portion parallel to said pulverized coal pipe and attached to and extending said first portion by forming an angle in the range of 90°–150° with said first portion, wherein the inner diameter of said pulverized coal pipe is less than the inner diameter formed by said second portion of said bluff body.

2. An apparatus according to claim 1, wherein the ratio of the inner diameter $d_1$ of said bluff body to the inner diameter $d_2$ of said pulverized coal pipe ($d_1/d_2$) is in the range of 0.7 to 1.0.

3. An apparatus according to claim 1, wherein the angle formed between two sides of the L-letter form member of said bluff body is 90°.

4. An apparatus according to claim 1, wherein the ratio of the difference between the outer diameter $d_3$ of said bluff body and the inner diameter $d_2$ of said pulverized coal pipe ($d_3-d_2$) to the difference between the inner diameter $d_4$ of said secondary air pipe and the inner diameter $d_2$ of said pulverized coal pipe ($d_4-d_2$), i.e. $(d_3-d_2)/(d_4-d_2)$ is 0.5 or more.

5. An apparatus according to claim 1, wherein an outwardly opening guide sleeve is provided at the tip end of said secondary air-feeding pipe, and the angle $\theta_2$ of this guide sleeve made with the horizontal axis is 30° or more.

6. An apparatus according to claim 1, wherein said burner throat forms a funnel-like part having its diameter enlarged toward the combustion furnace.

7. An apparatus according to claim 5, wherein said burner throat forms a funnel-like part having its diameter enlarged toward the combustion furnace, and the ratio of the difference between the outer diameter $d_5$ of said guide sleeve and the inner diameter $d_4$ of said secondary air-feeding pipe ($d_5-d_4$) to the difference between the inner diameter $d_6$ of said burner throat and the inner diameter $d_4$ of said secondary air-feeding pipe ($d_6-d_4$), i.e., $(d_5-d_4)/(d_6-d_4)$ is 0.5 or more.

8. An apparatus according to claim 1, wherein air whirling means is provided in the respective passageways of said secondary air and said ternary air.

9. An apparatus according to claim 8, wherein the whirling direction of said secondary air is the same as or contrary to that of said ternary air.

10. An apparatus according to claim 1, wherein said secondary air and said ternary air each independently have an air box, to thereby make it possible to independently control the respective flow amounts and injection pressures of said secondary and ternary airs.

11. An apparatus according to claim 1, wherein said secondary air and said ternary air independently have a fan, respectively, to thereby make it possible to independently control the respective flow amounts and injection pressures of said secondary and ternary airs.

12. An apparatus according to claim 1, wherein said secondary air and said ternary air independently have either one of an air box and a fan, respectively, to thereby make it possible to independently control the respective flow amount and injection pressures of said secondary and ternary airs.

13. An apparatus according to claim 1, constructed so that the amount of said ternary air injected can be 2.5 times or more that of said secondary air.

14. An apparatus according to claim 2, wherein $d_1/d_2$ is about 0.9.

15. An apparatus according to claim 4, wherein $(d_3-d_2/d_4-d_2)$ is in the range of 0.5 to 0.9.

16. An apparatus according to claim 5, wherein angle $\theta_2$ is in the range of 30°–50°.

17. An apparatus according to claim 6, wherein $(d_5-d_4)/(d_6-d_4)$ is in the range of 0.5 to 0.9.

* * * * *